US011702333B2

(12) United States Patent
Swanek et al.

(10) Patent No.: US 11,702,333 B2
(45) Date of Patent: Jul. 18, 2023

(54) ADDITIVE INJECTION SYSTEM FOR A RETAIL FUELING STATION AND RELATED METHODS

(71) Applicant: TOTAL METER SERVICES INC., Toronto (CA)

(72) Inventors: Dennis Swanek, Weston (CA); Jonathan Catangui, Markham (CA); Reem Fatahalla, Caledon (CA); Jasdeep Panag, Brampton (CA)

(73) Assignee: TOTAL METER SERVICES INC., Toronto (CA)

( * ) Notice: Subject to any disclaimer, the term of this patent is extended or adjusted under 35 U.S.C. 154(b) by 319 days.

(21) Appl. No.: 17/119,680

(22) Filed: Dec. 11, 2020

(65) Prior Publication Data

US 2021/0107782 A1 Apr. 15, 2021

Related U.S. Application Data

(63) Continuation of application No. PCT/CA2019/050831, filed on Jun. 12, 2019.
(Continued)

(51) Int. Cl.
*B67D 7/04* (2010.01)
*B67D 7/42* (2010.01)
(Continued)

(52) U.S. Cl.
CPC ..... *B67D 7/04* (2013.01); *B67D 7/423* (2013.01); *G07F 15/001* (2013.01); *B67D 2007/748* (2013.01)

(58) Field of Classification Search
CPC . B67D 7/04; B67D 7/74; B67D 7/423; B67D 2007/748
(Continued)

(56) References Cited

U.S. PATENT DOCUMENTS 5,022,428 A 6/1991 Vilines
5,163,586 A 11/1992 Zinsmeyer
(Continued)

FOREIGN PATENT DOCUMENTS

JP 3797482 B2 4/2006
WO 9003329 A1 4/1990
WO 2011037632 A1 3/2011

OTHER PUBLICATIONS

International Search Report and Written Opinion of corresponding International Patent Application No. PCT/CA2019/050831 dated Aug. 20, 2019, 8 pages.

*Primary Examiner* — Timothy L Maust
(74) *Attorney, Agent, or Firm* — Bereskin & Parr LLP/S.E.N.C.R.L., s.r.l.

(57) ABSTRACT

An additive injection system includes an additive injection controller operable to: (a) receive fuel data; (b) determine, from the fuel data, a total fuel amount corresponding to a total volume of fuel present in a fuel tank; (c) determine an untreated fuel amount corresponding to a delivered volume of untreated fuel delivered into the fuel tank, the untreated fuel amount determined based on the total fuel amount and a treated fuel amount corresponding to an expected volume of treated fuel expected to be present in the fuel tank; and (d) in response to determining that the untreated fuel amount exceeds an injection threshold, generate an injection signal to initiate injection of fuel additive into a fuel stream of untreated fuel being delivered into the fuel tank via the fuel tank inlet.

13 Claims, 5 Drawing Sheets

Related U.S. Application Data

(60) Provisional application No. 62/683,920, filed on Jun. 12, 2018.

(51) Int. Cl.
*B67D 7/74* (2010.01)
*G07F 15/00* (2006.01)

(58) Field of Classification Search
USPC ..... 141/102
See application file for complete search history.

(56) References Cited

U.S. PATENT DOCUMENTS 5,271,526 A * 12/1993 Williams ..... G05D 11/132 377/16
5,868,177 A 2/1999 Leahy
5,944,074 A 8/1999 Leahy et al.
6,095,371 A * 8/2000 Mooney ..... B01F 25/32 222/71
6,263,924 B1 * 7/2001 Grosser ..... B60K 15/00 141/98
7,428,890 B2 * 9/2008 Lay ..... F02M 37/0047 123/198 A
8,584,691 B2 * 11/2013 Hammonds ..... G05D 11/04 137/101.25
8,597,380 B2 * 12/2013 Buchanan ..... C10L 1/1824 585/14
9,057,308 B2 * 6/2015 Larsson ..... F01N 3/208
11,407,385 B2 * 8/2022 Nair ..... G05D 11/131
2005/0066576 A1 * 3/2005 Morris ..... G01F 9/00 44/639
2009/0187416 A1 * 7/2009 Baer ..... G07F 13/025 141/105
2013/0014853 A1 1/2013 Hunt et al.
2018/0237289 A1 * 8/2018 Markwardt ..... G05D 11/13
2020/0002154 A1 * 1/2020 Al Khowaiter ..... B67D 7/10
2021/0107782 A1 * 4/2021 Swan ..... B67D 7/78

* cited by examiner

ADDITIVE INJECTION SYSTEM FOR A RETAIL FUELING STATION AND RELATED METHODS

This application is a continuation of International Patent Application Serial No. PCT/CA2019/050831, filed Jun. 12, 2019, which claims the benefit of U.S. Provisional Application Ser. No. 62/683,920, filed Jun. 12, 2018, which is hereby incorporated herein by reference.

FIELD

The specification generally relates to treating fuel with additive, and more specifically, to systems and methods for treating fuel at a retail fueling station.

BACKGROUND

U.S. Pat. No. 5,944,074 purports to disclose an interchangeable additive injection apparatus providing a plurality of flow paths from one or more upstream additive tanks to one or more downstream fuel containers. A plurality of additive lines converge into an additive conduit at a manifold disposed within the apparatus. A plurality of valves associated with the additive lines are selectively opened and closed to isolate one of the flow paths. A metering device is disposed along the additive conduit for measuring the flow of additive therethrough. A reversible, multiple port housing surrounds at least the valves and manifold. In a forward orientation, a plurality of upstream ports are coupled to upstream additive tanks, and a downstream port is coupled to a fuel tank. By reversing the housing, the apparatus is placed in a reverse orientation wherein the upstream port is connected to an upstream additive tank and a plurality of downstream ports are connected to downstream fuel tanks. In either orientation, an expansion apparatus may be coupled to an expansion port on the additive injection apparatus to provide a number of additional ports and flow paths. A controller is coupled with the injection apparatus to monitor and control the associated pumps, valves, and meters.

SUMMARY

The following summary is intended to introduce the reader to various aspects of the applicant's teaching, but not to define any invention.

According to some aspects, a retail fueling station configured to treat fuel for dispensing to end users at the retail fueling station includes: (a) a fuel storage system for storing fuel, the fuel storage system including a fuel tank having a fuel tank inlet through which fuel is deliverable into the fuel tank; (b) one or more fuel dispensers connected to the fuel storage system and operable by the end users for dispensing fuel from the fuel tank; (c) a fuel monitoring system for generating fuel data based on input received from one or more fuel sensors, the fuel sensors for measuring operating conditions of the fuel storage system; (d) at least one additive tank for storing a fuel additive; (e) an additive conduit assembly for conducting additive from the additive tank to the fuel tank inlet of the fuel tank; and (f) an additive injection system for controlling injection of the additive from the additive tank into the fuel tank inlet via the conduit assembly, the additive injection system including an injection controller operable to: (i) receive the fuel data generated by the fuel monitoring system; (ii) determine, from the fuel data, a total fuel amount corresponding to a total volume of fuel present in the fuel tank at a detection time; (iii) determine an untreated fuel amount corresponding to a delivered volume of untreated fuel delivered into the fuel tank via the fuel tank inlet, the untreated fuel amount determined based on the total fuel amount and a treated fuel amount, the treated fuel amount corresponding to an expected volume of treated fuel expected to be present in the fuel tank at approximately the detection time; and (iv) in response to determining that the untreated fuel amount satisfies an injection threshold, initiate injection of an injection volume of fuel additive into a fuel stream of untreated fuel being delivered into the fuel tank via the fuel tank inlet, to treat the delivered volume of untreated fuel.

In some examples, the controller is operable to determine the treated fuel amount based on an evacuated fuel amount, the evacuated fuel amount corresponding to an evacuated volume of treated fuel evacuated from the fuel tank via operation of the dispensers.

In some examples, the controller is operable to determine the treated fuel amount based on a transferred fuel amount, the transferred fuel amount corresponding to a transferred volume of treated fuel transferred between the fuel tank and another fuel tank of the fuel storage system via a transfer line.

In some examples, the controller is operable to repeat (i) to (iv) for subsequent detection times to periodically inject the additive into the fuel stream in successive fuel treatment cycles until delivery of untreated fuel via the fuel tank inlet is terminated.

In some examples, the controller is operable to, for a subsequent detection time, determine the treated fuel amount based on the untreated fuel amount determined for a preceding fuel treatment cycle and an injected additive amount corresponding to the injection volume of additive injected into the fuel tank in the preceding fuel treatment cycle.

In some examples, the controller is operable to initiate operation of the additive injection system according to one or more injection parameters to inject the injection volume of the additive into the fuel stream; determine the injection volume injected during a first fuel treatment cycle; and adjust the one or more injection parameters to adjust the injection volume for a subsequent, second fuel treatment cycle based on the injection volume injected during the first fuel treatment cycle.

In some examples, the additive conduit assembly includes at least one retractable additive supply line for conducting the additive from the additive tank, and at least one handheld mixing nozzle having an additive inlet connectable to the additive supply line for receiving the additive, a fuel supply inlet connectable to a fuel supply line for receiving fuel, and a nozzle outlet in fluid communication with the fuel supply inlet and the additive inlet, the mixing nozzle positionable at the fuel tank inlet for delivering the fuel and the additive to the fuel tank inlet via the nozzle outlet.

According to some aspects, an additive injection system for treating fuel at a retail fueling station includes an additive injection controller operable to: (a) receive fuel data generated based on input received from one or more fuel sensors; (b) determine, from the fuel data, a total fuel amount corresponding to a total volume of fuel present in a fuel tank of the retail fueling station at a detection time; (c) determine an untreated fuel amount corresponding to a delivered volume of untreated fuel delivered into the fuel tank via a fuel tank inlet, the untreated fuel amount determined based on the total fuel amount and a treated fuel amount corresponding to an expected volume of treated fuel expected to be present in the fuel tank at approximately the detection time; and (d) in response to determining that the untreated fuel amount exceeds an injection threshold, generate an injection signal to initiate injection of an injection volume of fuel additive into a fuel stream of untreated fuel being delivered into the fuel tank via the fuel tank inlet, to treat the delivered volume of untreated fuel.

In some examples, the controller is operable to determine the treated fuel amount based on an evacuated fuel amount, the evacuated fuel amount corresponding to an evacuated volume of treated fuel evacuated from the fuel tank via operation of one or more dispensers of the retail fueling station.

In some examples, the controller is operable to determine the treated fuel amount based on a transferred fuel amount, the transferred fuel amount corresponding to a transferred volume of treated fuel transferred between the fuel tank and another fuel tank of the retail fueling station via a transfer line.

In some examples, the controller is operable to repeat (a) to (d) for subsequent detection times to periodically generate the injection signal to inject the additive into the fuel stream in successive fuel treatment cycles until delivery of untreated fuel via the tank inlet is terminated.

In some examples, the controller is operable to, for a subsequent detection time, determine the treated fuel amount based on the untreated fuel amount determined for a preceding fuel treatment cycle and an injected additive amount corresponding to the injection volume of additive injected into the fuel tank in the preceding fuel treatment cycle.

In some examples, the controller is operable to initiate operation of the additive injection system according to one or more injection parameters to inject the injection volume of the additive into the fuel stream; determine the injection volume injected during a first fuel treatment cycle; and adjust the one or more injection parameters to adjust the injection volume for a subsequent, second fuel treatment cycle based on the injection volume injected during the first fuel treatment cycle.

According to some aspects, a method of treating fuel to be dispensed to end users at a retail fueling station includes: (a) receiving fuel data generated based on input received from one or more fuel sensors of the retail fueling station; (b) determining, from the fuel data, a total fuel amount corresponding to a total volume of fuel present in a fuel tank of the fuel storage system at a detection time; (c) determining an untreated fuel amount corresponding to a delivered volume of untreated fuel delivered into the fuel tank via a fuel tank inlet, the untreated fuel amount determined based on the total fuel amount and a treated fuel amount corresponding to an expected volume of treated fuel expected to be present in the fuel tank at approximately the detection time; and (d) in response to determining that the untreated fuel amount exceeds an injection threshold, initiating injection of an injection volume of fuel additive into a fuel stream of untreated fuel being delivered into the fuel tank via the fuel tank inlet, to treat the delivered volume of untreated fuel.

In some examples, the method further includes determining the treated fuel amount based on an evacuated fuel amount, the evacuated fuel amount corresponding to an evacuated volume of treated fuel evacuated from the fuel tank via operation of one or more dispensers of the retail fueling station.

In some examples, the method further includes determining the treated fuel amount based on a transferred fuel amount, the transferred fuel amount corresponding to a transferred volume of treated fuel transferred between the fuel tank and another fuel tank of the retail fueling station via a transfer line.

In some examples, the method further includes repeating (a) to (d) for subsequent detection times to periodically inject the additive into the fuel stream in successive fuel treatment cycles until delivery of untreated fuel via the fuel tank inlet is terminated.

In some examples, the method further includes, for a subsequent detection time, determining the treated fuel amount based on the untreated fuel amount determined for a preceding fuel treatment cycle and an injected additive amount corresponding to the injection volume of additive injected into the fuel tank in the preceding fuel treatment cycle.

In some examples, (d) includes initiating operation of an additive injection system according to one or more injection parameters to inject the injection volume of the additive into the fuel stream, and the method further includes determining the injection volume injected during a first fuel treatment cycle; and adjusting the one or more injection parameters to adjust the injection volume for a subsequent, second fuel treatment cycle based on the injection volume injected during the first fuel treatment cycle.

According to some aspects, a fuel treatment system, for treating fuel at a retail fueling station including at least a first fuel tank having a first fuel tank inlet and a second fuel tank having a second fuel tank inlet, includes: (a) at least one additive tank for storing a fuel additive; (b) at least one retractable additive supply line for conducting the additive from the additive tank; (c) at least one hand-held mixing nozzle having an additive inlet connectable to the additive supply line for receiving the additive, a fuel supply inlet connectable to a fuel supply line for receiving fuel, and a nozzle outlet in fluid communication with the fuel supply inlet and the additive inlet, the mixing nozzle positionable at either of (i) the first fuel tank inlet for delivering the fuel and the additive to the first fuel tank inlet via the nozzle outlet and (ii) the second fuel tank inlet for delivering the fuel and the additive to the second fuel tank inlet via the nozzle outlet; and (d) an additive injection system operable to control injection of the additive through the additive supply line, the additive injection system including an injection controller operable to: in response to determining that the mixing nozzle is at the first fuel tank inlet, control injection of the additive through the additive supply line connected to the mixing nozzle at the first fuel tank inlet based on one or more first fuel tank operating conditions of the first fuel tank, and in response to determining that the mixing nozzle is at the second fuel tank inlet, control injection of the additive through the additive supply line connected to the mixing nozzle at the second fuel tank inlet based on one or more second fuel tank operating conditions of the second fuel tank.

In some examples, the injection controller is operable to receive fuel data from a fuel monitoring system of the retail fueling station, the fuel data indicative of the first fuel tank operating conditions and the second fuel tank operating conditions.

In some examples, the first fuel tank operating conditions include at least a first fuel level in the first fuel tank, and the second fuel tank operating conditions include at least a second fuel level in the second fuel tank.

In some examples, the first fuel tank operating conditions include at least a first volume of fuel evacuated from the first fuel tank, and the second fuel tank operating conditions include at least a second volume of fuel evacuated from the second fuel tank.

In some examples, each mixing nozzle includes at least one fuel tank identification sensor operable to generate at least one first fuel tank identification signal when the mixing nozzle is at the first fuel tank inlet and at least one second fuel tank identification signal when the mixing nozzle is at the second fuel tank inlet.

In some examples, the fuel tank identification sensor is operable to generate the first fuel tank identification signal in response to detecting a first fuel tank identifier at the first fuel tank inlet, and to generate the second fuel tank identification signal in response to detecting a second fuel tank identifier at the second fuel tank inlet.

In some examples, the injection controller is operable to determine that the mixing nozzle is at the first fuel tank inlet based on the first fuel tank identification signal and that the mixing nozzle is at the second fuel tank inlet based on the second fuel tank identification signal.

In some examples, the at least one additive supply line includes a plurality of additive supply lines, and the at least one mixing nozzle includes a plurality of mixing nozzles, each mixing nozzle associable with a respective additive supply line.

In some examples, the plurality of additive supply lines include at least a first additive supply line and a second additive supply line, and the plurality of mixing nozzles includes at least a first mixing nozzle connected to the first additive supply line and a second mixing nozzle connected to the second additive supply line.

In some examples, the first additive supply line has a first supply line inlet coupled to the additive tank for receiving the additive therefrom and the second additive supply line has a second supply line inlet coupled to the additive tank for receiving the additive therefrom.

In some examples, the at least one additive tank comprises a first additive tank for storing a first fuel additive and a second additive tank for storing a second fuel additive, and wherein the first additive supply line inlet is coupled to the first additive tank for receiving the first additive therefrom, and the second additive supply line inlet is coupled to the second additive tank for receiving the second additive therefrom.

According to some aspects, a portable fuel treatment system, for treating fuel at a retail fueling station including at least one fuel tank having a fuel tank inlet, includes: (a) a transportable housing; (b) at least one additive tank in the housing for storing a fuel additive; (c) at least one retractable additive supply line supported by the housing for conducting the additive from the additive tank; (d) at least one hand-held mixing nozzle supported by the housing, the mixing nozzle having an additive inlet connectable to the additive supply line for receiving the additive, a fuel supply inlet connectable to a fuel supply line for receiving fuel, and a nozzle outlet in fluid communication with the fuel supply inlet and the additive inlet, the mixing nozzle positionable at the fuel tank inlet for delivering the fuel and the additive to the fuel tank inlet via the nozzle outlet; and (e) an additive injection system supported by the housing for controlling injection of the additive via the additive supply line and the mixing nozzle.

In some examples, the additive injection system includes at least one injection controller operable to control injection of the additive based on fuel data received from a fuel monitoring system of the retail fueling station, the fuel data indicative of one or more operating conditions of the fuel tank.

BRIEF DESCRIPTION OF THE DRAWINGS

The drawings included herewith are for illustrating various examples of systems, methods, and apparatuses of the present specification and are not intended to limit the scope of what is taught in any way. In the drawings.

DETAILED DESCRIPTION

Various systems, processes, and apparatuses will be described below to provide an example of an embodiment of each claimed invention. No embodiment described below limits any claimed invention and any claimed invention may cover systems, processes, or apparatuses that differ from those described below. The claimed inventions are not limited to systems, processes, or apparatuses having all of the features of any one system, process, or apparatus described below or to features common to multiple or all of the systems, processes, or apparatuses described below. It is possible that a system, process, or apparatus described below is not an embodiment of any claimed invention. Any invention disclosed in a system, process, or apparatus described below that is not claimed in this document may be the subject matter of another protective instrument, for example, a continuing patent application, and the applicants, inventors, or owners do not intend to abandon, disclaim, or dedicate to the public any such invention by its disclosure in this document.

Figure 1:
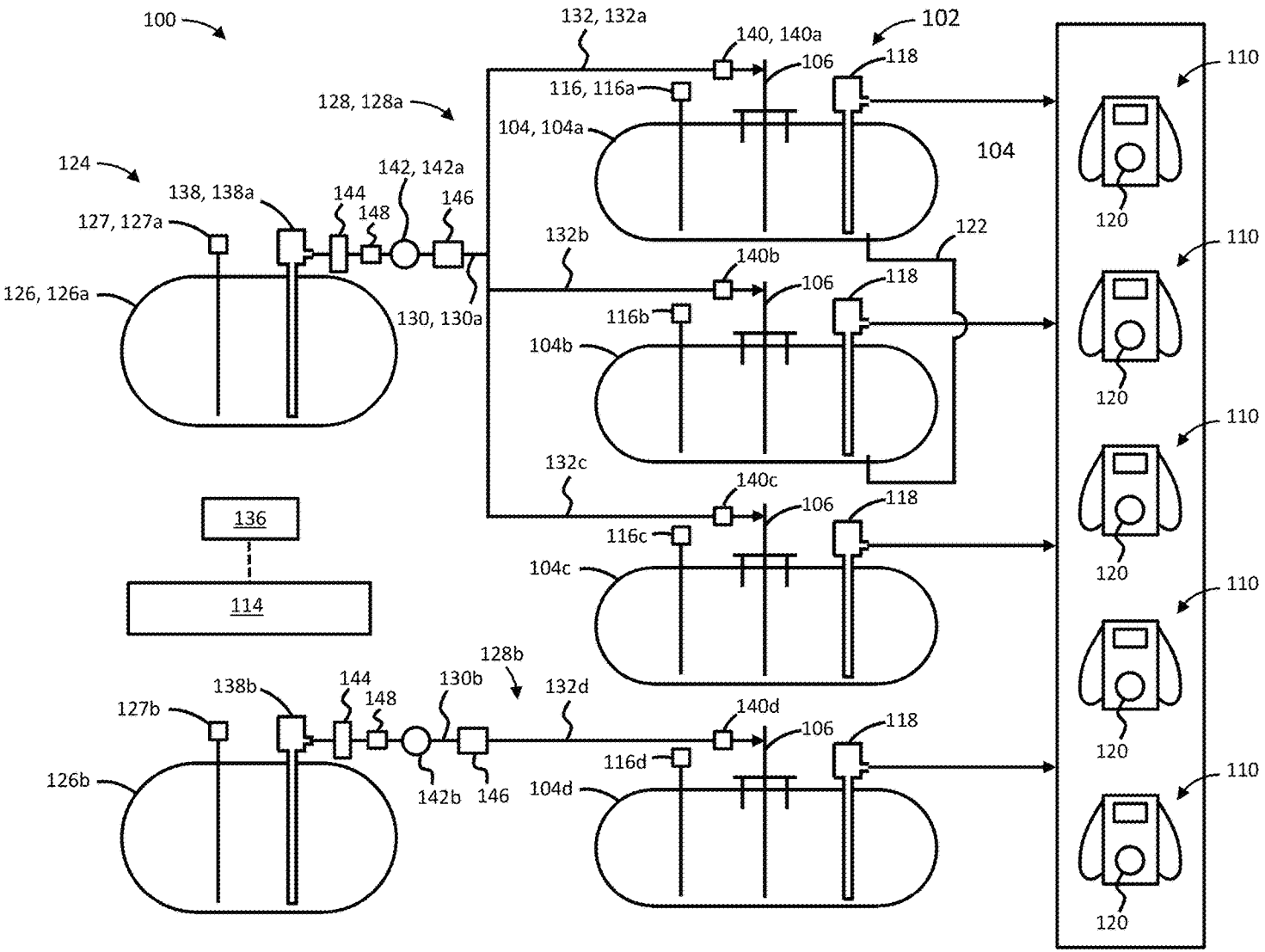
FIG. 1 is a schematic of an example retail fueling station having a fuel treatment system.

Referring to FIG. 1, an example retail fueling station 100 configured to treat fuel for dispensing to end users is shown. In the example illustrated, the retail fueling station 100 includes a fuel storage system 102 for storing fuel to be dispensed to the end users. In the example illustrated, the fuel storage system 102 includes at least one fuel tank 104 for storing the fuel. The fuel tank 104 can be, for example, an underground fuel storage tank. In the example illustrated, the fuel tank 104 has a fuel tank inlet 106 through which fuel is deliverable into the fuel tank 104. In the example illustrated, the fuel tank inlet 106 is absent a sensor (e.g. an inlet flow meter) operable to monitor flow of fuel being delivered into the fuel tank 104 through the fuel tank inlet 106.

In the example illustrated, the fuel storage system 102 includes a plurality of the fuel tanks 104, including a first fuel tank 104*a*, a second fuel tank 104*b*, a third fuel tank 104*c*, and a fourth fuel tank 104*d*. In the example illustrated, the first and the second fuel tanks 104*a*, 104*b* are used to store a first type of fuel. The first type of fuel can include, for example, regular grade gasoline. In the example illustrated, the first and second fuel tanks 104*a*, 104*b* are connected via a transfer line 122 for facilitating transfer of fuel between the first and second fuel tanks 104*a*, 104*b*. The transfer line 122 can comprise a siphon line for facilitating siphoning of fuel between the first fuel tank 104*a* and the second fuel tank 104*b* to help maintain equal fuel levels in the first and second fuel tanks 104*a*, 104*b*.

In the example illustrated, the third fuel tank 104*c* is used to store a third type of fuel. The third type of fuel can include, for example, premium grade gasoline. In the example illustrated, the fourth fuel tank 104*d* is used to store a fourth type of fuel. The fourth type of fuel can include, for example, diesel fuel.

In the example illustrated, the retail fueling station 100 further includes one or more fuel dispensers 110 connected to the fuel storage system 102 and operable by the end users for dispensing fuel from the fuel tanks 104. In the example illustrated, a tank pump 118 is provided for each fuel tank 104 for pumping fuel from the fuel tanks 104 to one or more of the dispensers 110.

Figure 2:
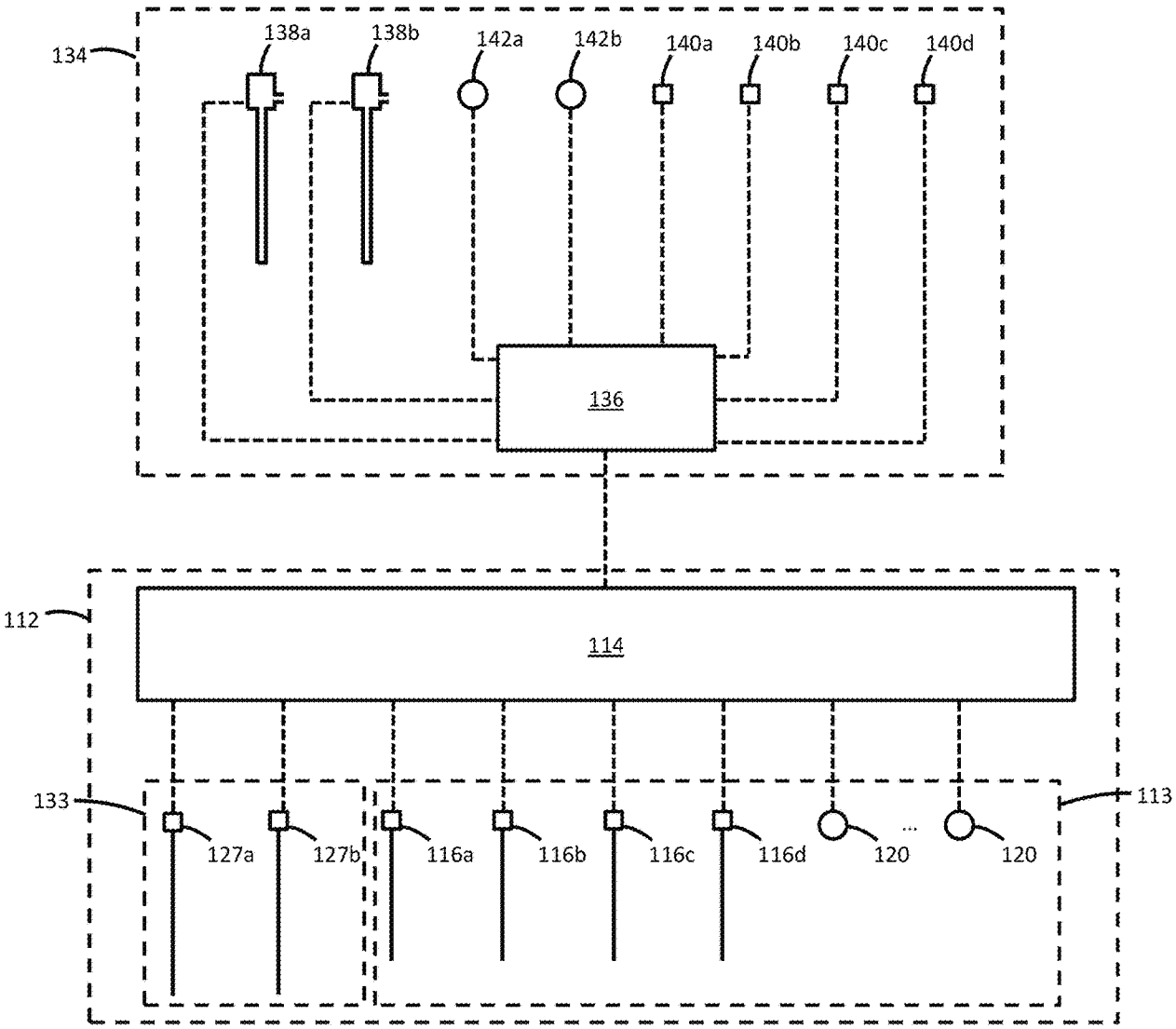
FIG. 2 is a schematic illustrating fuel monitoring and additive injection systems of the retail fueling station of FIG. 1.

Referring to FIG. 2, in the example illustrated, the retail fueling station 100 further includes a fuel monitoring system 112 operable to monitor one or more operating conditions of the fuel storage system 102. In the example illustrated, the fuel monitoring system 112 includes one or more fuel sensors 113 associated with the fuel storage system 102 for detecting the operating conditions of the fuel storage system 102. In the example illustrated, the fuel monitoring system 112 further includes a fuel monitoring controller 114 in communication with the sensors 113 and operable to generate fuel data based on input received from the fuel sensors 113.

In the example illustrated, the fuel data is indicative of at least a total volume of fuel present in one or more of the fuel tanks 104. Referring to FIG. 1, in the example illustrated, the fuel sensors 113 include a fuel level sensor 116 (e.g. a fuel level probe) for each fuel tank 104. Each fuel level sensor 116 is operable to measure a level of fuel stored in a respective fuel tank 104, and to generate fuel level signals indicative of the level of fuel. In the example illustrated, the fuel monitoring controller 114 is operable to generate fuel data indicative of the total volume of fuel based on the fuel level signals. In the example illustrated, the fuel sensors 113 include a plurality of the fuel level sensors 116, including first, second, third, and fourth fuel level sensors 116*a-d* in the first, second, third, and fourth fuel tanks 104*a-d*, respectively.

In some examples, the fuel data can be indicative of an evacuated volume of treated fuel evacuated from the fuel tanks 104 via operation of the dispensers 110. In the example illustrated, the fuel sensors 113 include one or more dispenser flow meters 120. The dispenser flow meters 120 are operable to measure volumetric flow of fuel evacuated from each fuel tank 104 via operation of the dispensers 110, and to generate dispenser flow signals indicative of the volumetric flow. In the example illustrated, the fuel monitoring controller 114 is operable to generate fuel data indicative of the evacuated fuel volume based on the dispenser flow signals.

In the example illustrated, the retail fueling station 100 further includes a fuel treatment system 124 for treating fuel for dispensing to end users at the retail fueling station 100. In the example illustrated, the fuel treatment system includes at least one additive tank 126 for storing a fuel additive for injection into one or more of the fuel tanks 104. The fuel additive can comprise compositions for treating fuel. The fuel additive can be blended with fuel such as, for example, gasoline to, for example, increase an octane rating of the gasoline, and/or act as a corrosion inhibitor and/or a lubricant. In the example illustrated, the retail fueling station 100 includes a plurality of the additive tanks 126, including a first additive tank 126*a* for storing a first additive for injection into each of the first, second, and third fuel tanks 104*a-c*, and a second additive tank 126*b* for storing a second additive for injection into the fourth fuel tank 104*d*. In the example illustrated, the first additive comprises a gasoline additive, and the second additive comprises a diesel additive.

In the example illustrated, the fuel treatment system 124 includes an additive conduit assembly 128 provided between each additive tank 126 and respective fuel tanks 104 for conducting additive to the fuel tanks 104. In the example illustrated, the additive conduit assembly 128 includes a first conduit assembly 128*a* for conducting the first additive from the first additive tank 126*a* to each of the first, second, and third fuel tanks 104*a-c*, and a second conduit assembly 128*b* for conducting the second additive from the second additive tank 126*b* to the fourth fuel tank 104*d*.

In the example illustrated, each additive conduit assembly 128 includes an additive header 130 for receiving additive from a respective additive tank 126, and at least one additive line 132 for conducting the additive from the additive header 130 to the fuel tank inlet 106 of a respective fuel tank 104. In the example illustrated, the first conduit assembly 128*a* includes a first additive header 130*a* for receiving the first additive from the first additive tank 126*a*. The first conduit assembly 128*a* further includes first, second, and third additive lines 132*a-c* connected to the first additive header 130*a* for conducting the first additive from the first additive header 130*a* to respective tank inlets 106 of the first, second, and third fuel tanks 104*a-c*, respectively. In the example illustrated, the second conduit assembly 128*b* includes a second additive header 130*b* for receiving the second additive from the second additive tank 126*b*. The second conduit assembly 128*b* further includes a fourth additive line 132*d* connected to the second additive header 130*b* for conducting the second additive from the second additive header 130*b* to the fuel tank inlet 106 of the fourth fuel tank 104*d*.

In the example illustrated, the fuel monitoring system 112 is further operable to monitor operating conditions of the additive tanks 126. Referring to FIG. 2, in the example illustrated, the fuel monitoring system 112 includes one or more additive sensors 133 associated with the additive tanks 126 for detecting the operating conditions of the additive tanks 126. The fuel monitoring controller 114 is in communication with the sensors 133 and operable to generate additive data based on input from the additive sensors 133.

In the present example, the additive data is indicative of a total volume of additive in one or more of the additive tanks 126. Referring to FIG. 1, in the example illustrated, the additive sensors 133 include an additive level sensor 127 for each additive tank 126. Each additive level sensor 127 is operable to measure a level of additive stored in a respective additive tank 126, and to generate additive level signals indicative of the level of additive. In the example illustrated, the fuel monitoring controller 114 is operable to generate additive data indicative of the total volume of additive based on the additive level signals. In the example illustrated, the additive sensors 133 include a plurality of the additive level sensors 127, including first and second additive level sensors 127*a*, 127*b* in the first and second additive tanks 126*a*, 126*b*, respectively.

Referring to FIG. 2, in the example illustrated, the fuel treatment system 124 further includes an additive injection system 134 for controlling injection of the additive via the additive conduit assembly 128. In the example illustrated, the additive injection system 134 includes at least one additive injection controller 136 operable in accordance with the methods described herein for controlling operation of the injection system 134. In the present example, the injection controller 136 is operable to receive fuel data generated by the fuel monitoring system 112, and to control operation of the injection system 134 based at least in part on the fuel data. In some examples, the additive injection system 134 may include the additive sensors 133, and may be operable to monitor the operating conditions of the additive tanks 126 via the additive sensors 133.

Referring to FIG. 1, in the example illustrated, the additive injection system 134 includes one or more additive pumps 138 coupled to the additive conduit assembly 128 for pumping additive from one or more additive tanks 126. In the example illustrated, the injection controller 136 is in communication with each additive pump 138, and is operable to initiate operation of one or more of the additive pumps 138 to pump additive from one or more of the additive tanks 126 to one or more of the fuel tanks 104 through the additive conduit assembly 128. In the example illustrated, the additive injection system 134 includes a plurality of the additive pumps 138, including a first additive pump 138*a* coupled to the first conduit assembly 128*a* for pumping the first additive from the first additive tank 126*a* to the first, second, and third fuel tanks 104*a-c* via the first conduit assembly 128*a*, and a second additive pump 138*b* coupled to the second conduit assembly 128*b* for pumping the second additive from the second additive tank 126*b* to the fourth fuel tank 104*d* via the second conduit assembly 128*b*.

In the example illustrated, the additive injection system 134 further includes at least one electronic valve 140 (e.g. a solenoid valve) for each additive line 132. Each electronic valve 140 is movable between a closed position for blocking fluid communication between a respective additive tank 126 and a respective fuel tank 104 via the additive line 132, and an open position for permitting flow of additive from the additive tank 126 to the fuel tank 104 via the additive line 132. In the example illustrated, the injection controller 136 is in communication with each electronic valve 140 (FIG. 2) for controlling operation of each valve 140 to selectively permit and block flow of additive between the additive tanks 126 and the fuel tanks 104. In the example illustrated, the additive injection system 134 includes a plurality of the electronic valves 140, including first, second, third, and fourth electronic valves 140*a-d* in the first, second, third, and fourth additive lines 132*a-d*, respectively.

In the example illustrated, the additive injection system 134 further includes one or more additive flow meters 142 coupled to the additive conduit assembly 128. The additive flow meters 142 are operable to measure volumetric flow of additive flowing through the additive conduit assembly 128 from one or more additive tanks 126 to one or more fuel tanks 104, and to generate additive flow signals indicative of the volumetric flow. In the example illustrated, the injection controller 136 is operable to receive the additive flow signals, and to determine the volumetric flow of the additive based on the additive flow signals. In the example illustrated, the additive injection system 134 includes a plurality of the additive flow meters 142, including a first additive flow meter 142*a* coupled to the first additive header 130*a* downstream of the first additive pump 138*a* for measuring volumetric flow of the first additive flowing through the first conduit assembly 128*a*, and a second additive flow meter 142*b* coupled to the second additive header 130*b* downstream of the second additive pump 138*b* for measuring volumetric flow of the second additive flowing through the second conduit assembly 128*b*.

In the example illustrated, the additive injection system 134 further includes at least one filter 144 (e.g. a micron filter) for filtering impurities from additive flowing through the additive conduit assembly 128. In the example illustrated, a micron filter 144 is provided in each additive header 130 intermediate the additive pump 138 and the additive flow meter 142.

In the example illustrated, the additive injection system 134 further includes at least one flow control valve 146 (e.g. a needle valve) for controlling a flow rate of additive flowing through the additive conduit assembly 128. In the example illustrated, a flow control valve 146 is provided in each additive header 130 downstream of the additive flow meter 142.

In the example illustrated, the additive injection system 134 further includes at least one check valve 148 for inhibiting back flow of additive through the additive conduit assembly 128. In the example illustrated, a check valve 148 is provided in each additive header 130 intermediate the additive flow meter 142 and the filter 144.

Components of the fuel treatment system 124 (e.g. the additive tanks, conduit assemblies, and/or injection system components) may be permanent underground installations, and/or may be installed above ground (e.g. like the components of the fuel treatment system 1124 described below).

Figure 3:
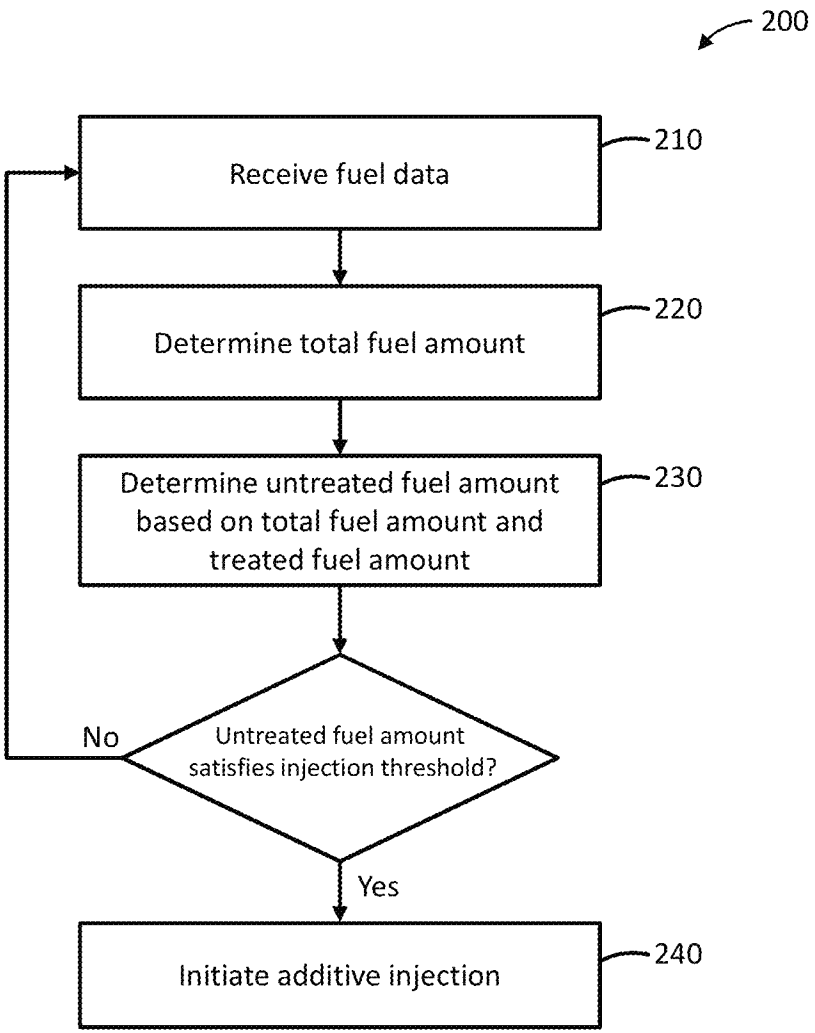
FIG. 3 is a flow chart of an example method for controlling treatment of fuel at a retail fueling station like the station of FIG. 1.

Referring to FIG. 3, an example method 200 is shown according to which an injection controller similar to the injection controller 136 is operable to control an injection system similar to the system 134 to treat fuel for dispensing to end users at a retail fueling station similar to the station 100. The method 200 will be described with respect to the injection system 134, the first additive tank 126*a*, and the first fuel tank 104*a*, and the method 200 is also applicable with respect to the second and third fuel tanks 104*b*, 104*c*, as well as the second additive tank 126*b* and the fourth fuel tank 104*d*.

At 210 of the method 200, the injection controller receives fuel data generated by the fuel monitoring system 112.

At 220, the injection controller determines, from the fuel data, a total fuel amount corresponding to a total volume of fuel present in the first fuel tank 104*a* at a detection time. In the present example, the injection controller can determine the total fuel amount from fuel data generated based on input received from the first fuel level sensor 116*a*.

At 230, the injection controller 136 determines an untreated fuel amount corresponding to a delivered volume of untreated fuel delivered into the first fuel tank 104*a* via the fuel tank inlet 106. In the present example, the injection controller determines the untreated fuel amount based on the total fuel amount and a treated fuel amount corresponding to an expected volume of treated fuel expected to be present in the first fuel tank 104*a* at approximately the detection time. In some examples, the injection controller can determine the untreated fuel amount based on a difference between the total fuel amount and the treated fuel amount.

In some examples, the injection controller 136 may determine the treated fuel amount based on a prior total fuel amount corresponding to a total volume of fuel present in the first fuel tank 104*a* at a prior detection time. For example, the injection controller may determine that the treated fuel amount corresponds to the prior total fuel amount.

In some examples, the injection controller may determine the treated fuel amount based on the prior total fuel amount and an amount of treated fuel evacuated from the first fuel tank 104*a* and/or transferred between the first fuel tank 104*a* and the second fuel tank 104*b* since the prior detection time. For example, in cases where there has been no treated fuel evacuated from the first fuel tank 104*a* and/or transferred between the first fuel tank 104*a* and the second fuel tank 104*b* since the prior detection time, the injection controller may determine that the treated fuel amount corresponds to the prior total fuel amount. In cases where a volume of treated fuel has been evacuated and/or transferred from the first fuel tank 104*a* since the prior detection time, the injection controller 136 may determine that the treated fuel amount corresponds to the prior total fuel amount less the amount of treated fuel evacuated and/or transferred from the first fuel tank 104*a* since the prior detection time.

In the present example, the injection controller 136 can determine the treated fuel amount based on an evacuated fuel amount corresponding to an evacuated volume of treated fuel evacuated from the first fuel tank via operation of the dispensers 110. The injection controller can determine the evacuated fuel amount from fuel data generated based on input received from the dispenser flow meters 120.

In the present example, the injection controller 136 can determine the treated fuel amount based on a transferred fuel amount corresponding to a transferred volume of treated fuel transferred between the first fuel tank 104*a* and the second fuel tank 104*b* via the transfer line 122. In the present example, the injection controller 136 can determine the transferred fuel amount based on a first fuel level amount corresponding to a fuel level in the first fuel tank 104*a*, a second fuel level amount corresponding to a fuel level in the second fuel tank 104*b*, and known fluid flow parameters of the transfer line 122. The injection controller 136 can determine the first and second fuel level amounts from fuel data generated based on input received from the first and second fuel level sensors 116*a*, 116*b*. In some examples, the fluid flow parameters may be predetermined and programmed into computer readable memory accessible by the injection controller 136.

After 230, the injection controller determines whether the untreated fuel amount satisfies an injection threshold. In the present example, the injection threshold defines a volume of untreated fuel required to be delivered into the first fuel tank 104*a* to initiate injection of an injection volume of additive. The injection threshold can be defined based on a desired rate of additive injection, and the injection volume can be determined based on the injection threshold and a predetermined ratio of fuel to additive.

The injection controller 136 may determine that the untreated fuel amount satisfies the injection threshold in response to, for example, the delivered volume of untreated fuel delivered into the first fuel tank 104*a* via the fuel tank inlet 106 meeting or exceeding the volume of untreated fuel required to be delivered into the first fuel tank 104*a* to initiate additive injection. The injection controller 136 may determine that the untreated fuel amount does not satisfy the injection threshold in response to, for example, the delivered volume of untreated fuel delivered into the first fuel tank 104*a* via the fuel tank inlet 106 not meeting or exceeding the volume of untreated fuel required to be delivered into the first fuel tank 104*a* to initiate additive injection.

In response to the injection controller 136 determining that the untreated fuel amount does not satisfy the injection threshold, the controller can repeat 210 to 230 for subsequent detection times.

In response to the injection controller 136 determining that the untreated fuel amount satisfies the injection threshold, the controller proceeds to 240 of the method 200. At 240, the injection controller 136 generates an injection signal to initiate injection of an injection volume of fuel additive from the first additive tank 126*a* into a fuel stream of untreated fuel being delivered into the first fuel tank 104*a* via the fuel tank inlet 106, to treat the delivered volume of untreated fuel.

In the present example, the injection controller repeats 210 to 240 for subsequent detection times to periodically inject the additive into the fuel stream in successive fuel treatment cycles until delivery of untreated fuel via the fuel tank inlet 106 is terminated. In some examples, the injection controller 136 can determine that delivery of untreated fuel is terminated in response to the total fuel volume corresponding to the treated fuel volume for one or more subsequent detection times.

In the present example, for subsequent detection times, the injection controller 136 can determine the treated fuel amount based on the untreated fuel amount determined for a preceding fuel treatment cycle and an injected additive amount corresponding to the injection volume of additive injected into the first fuel tank 104*a* in the preceding fuel treatment cycle. For example, the untreated fuel amount and injected additive amount for a preceding fuel treatment cycle can be included in the treated fuel amount determined for a subsequent detection time.

In the present example, at 240, the injection controller initiates operation of the additive injection system according to one or more injection parameters to inject the injection volume of the additive into the fuel stream. In some examples, after 240, the controller 136 determines the injection volume injected during a first fuel treatment cycle, and adjusts the one or more injection parameters to adjust the injection volume for a subsequent, second fuel treatment cycle based on the injection volume injected during the first fuel treatment cycle. This can help the injection system 134 to, for example, compensate for previously inaccurate additive doses.

In the present example, the injection controller 136 can determine the injection volume injected during a fuel treatment cycle based on the additive flow signals generated by the additive flow meter 142*a*. In some examples, the injection controller 136 can determine the injection volume injecting during a fuel treatment cycle from additive data generated based on input received from the additive level sensor 127*a*.

Figure 4:
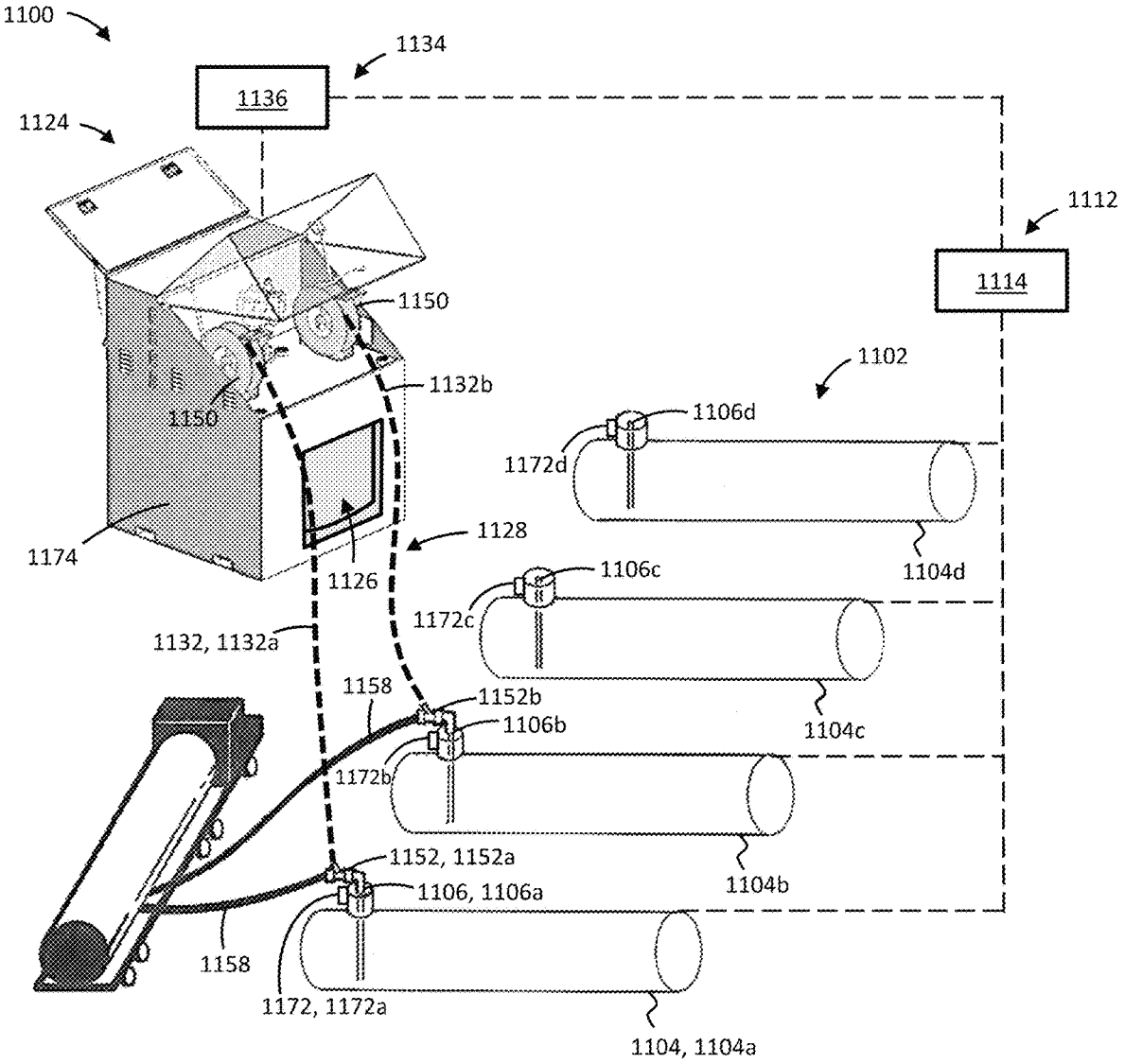
FIG. 4 is a schematic of another example retail fueling station having a fuel treatment system.

Referring to FIG. 4, another example retail fueling station 1100 is shown. The retail fueling station 1100 has similarities to the fueling station 100, and like features are identified with like reference characters, incremented by 1000.

In the example illustrated, the retail fueling station 1100 includes a fuel storage system 1102. The fuel storage system 1102 includes at least one fuel tank 1104 having a fuel tank inlet 1106 through which fuel is deliverable into the fuel tank 1104. In the example illustrated, the fuel tank inlet 1106 is absent a sensor (e.g. an inlet flow meter) operable to monitor flow of fuel being delivered through the fuel tank inlet 1106. In the example illustrated, the fuel storage system 1102 includes a plurality of the fuel tanks 1104, including a first, second, third, and fourth fuel tank 1104*a-d* having respective first, second, third, and fourth fuel tank inlets 1106*a-d*.

The retail fueling station 1100 can further include one or more fuel dispensers (similar to the dispensers 110) operable by end users for dispensing fuel from the fuel tanks 1104, and tank pumps (similar to tank pumps 118) for pumping fuel from the fuel tanks 1104 to one or more of the dispensers. The retail fueling station 1100 further includes a fuel monitoring system 1112 operable to monitor operating conditions of the fuel storage system 1102. The fuel monitoring system 1112 can include one or more fuel sensors (similar to the sensors 113) associated with the fuel storage system 1102 for detecting the operating conditions of the fuel storage system 1102, and a fuel monitoring controller 1114 operable to generate fuel data indicative of the operating conditions based on input from the fuel sensors. In the example illustrated, the operating conditions can comprise, for example, at least a fuel level in each of the fuel tanks 1104 indicative of a total amount of fuel in each fuel tank 1104, and/or an evacuated volume of fuel evacuated from each fuel tank 1104 via operation of one or more of the dispensers.

In the example illustrated, the retail fueling station 1100 further includes a fuel treatment system 1124 for treating fuel for dispensing to end users at the fueling station 1100. In the example illustrated, the fuel treatment system 1124 includes at least one additive tank 1126 for storing a fuel additive for injection into one or more of the fuel tanks 1104. In the example illustrated, the fuel treatment system 1124 includes an additive conduit assembly 1128 for conducting the additive from the additive tank 1126 to the fuel tank inlet 1106 of any one of the fuel tanks 1104. In the example illustrated, the additive conduit assembly 1128 includes at least one additive supply line 1132 for conducting the additive from the additive tank 1126. In the example illustrated, each additive supply line 1132 is retractable, and in the present example, is mounted on a respective reel 1150 to facilitate extension and retraction of the additive supply line 1132.

Figure 5:
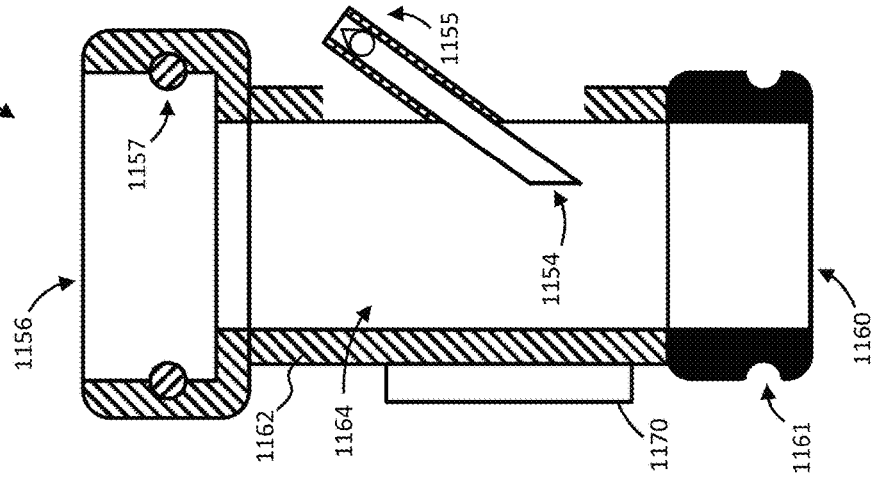
FIG. 5 is a schematic cross-sectional view of a mixing nozzle of the fuel treatment system of FIG. 4.

In the example illustrated, the additive conduit assembly 1128 further includes at least one hand-held mixing nozzle 1152. Referring to FIG. 5, in the example illustrated, each mixing nozzle 1152 has an additive inlet 1154 connectable to the additive supply line 1132 (FIG. 4) for receiving the additive, a fuel supply inlet 1156 connectable to a fuel supply line 1158 (FIG. 4) for receiving fuel, and a nozzle outlet 1160 in fluid communication with the fuel supply inlet 1156 and the additive inlet 1154. In the example illustrated, the mixing nozzle 1152 is positionable at the fuel tank inlet 1106 of any one of the fuel tanks 1104 for delivering the fuel and the additive to the fuel tank inlet 1106 via the nozzle outlet 1160.

In the example illustrated, the mixing nozzle 1152 has mixing nozzle body 1162 and an internal mixing nozzle conduit 1164 extending through the mixing nozzle body 1162 between the fuel supply inlet 1156 and the nozzle outlet 1160. During injection of the additive, the additive inlet 1154 is open to the mixing nozzle conduit 1164 for injection of the additive into a stream of fuel passing through the mixing nozzle conduit 1164 from the fuel supply inlet 1156 to the nozzle outlet 1160. In the example illustrated, each mixing nozzle 1152 is positionable at the fuel tank inlet 1106 by user, and includes a handle 1166 (FIG. 5) to facilitate handling and positioning of the nozzle 1152 by the user. In the example illustrated, each nozzle 1152 includes a fuel supply inlet connection feature 1157 at the fuel supply inlet 1156 for releasably connecting the fuel supply line 1158 to the fuel supply inlet 1156, and a nozzle outlet connection feature 1161 at the nozzle outlet 1160 for releasably connecting the nozzle outlet 1160 to the fuel tank inlet 1106. In the example illustrated, each nozzle 1152 further includes an additive inlet connection feature 1155 for releasably connecting the additive supply line 1132 to the additive inlet 1154. Each additive supply line 1132 can include a corresponding additive supply line connection feature for engagement with the additive inlet connection feature 1155. Each of the fuel supply inlet connection feature 1157, the nozzle outlet connection feature 1161, additive inlet connection feature 1155, and additive supply line connection feature can comprise a respective quick connect fitting.

Figure 6:
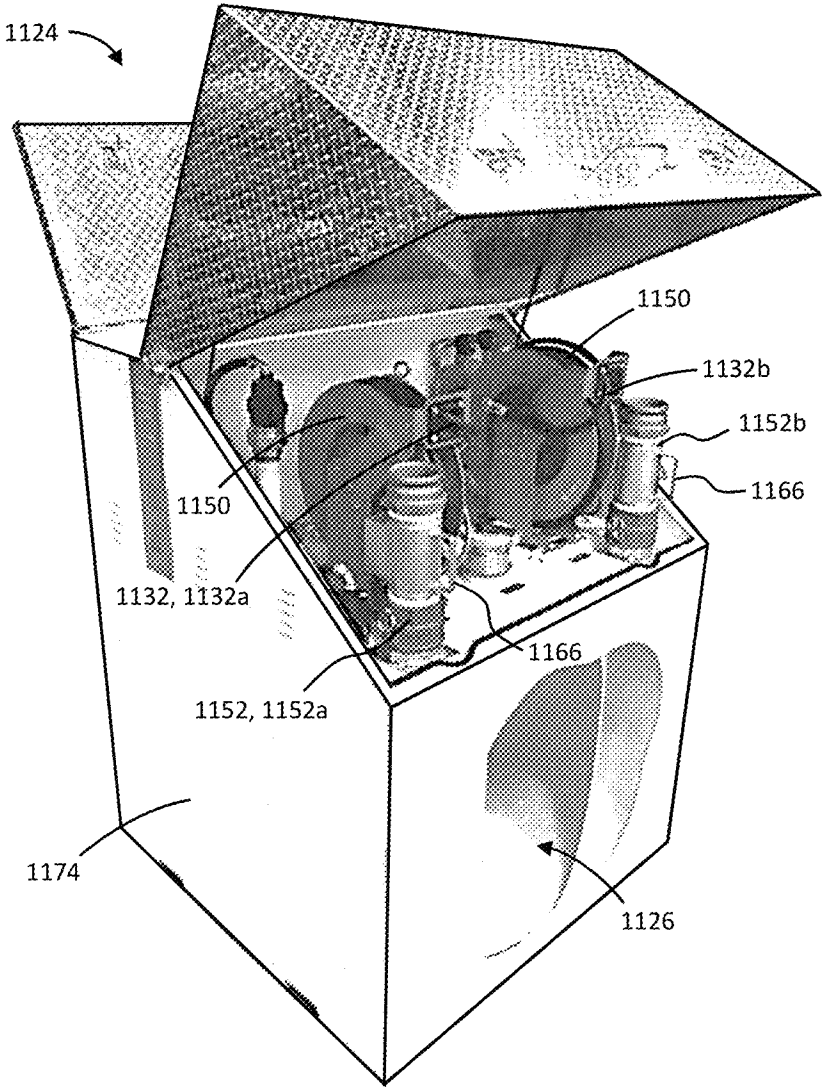
FIG. 6 is a front perspective view of the fuel treatment system of FIG. 4.

Referring to FIG. 4, in the example illustrated, the additive conduit assembly 1128 includes a plurality of additive supply lines 1132 and a plurality of the mixing nozzles 1152, and each mixing nozzle 1152 is associable with a respective additive supply line 1132 in the present example. In the example shown in FIG. 4, the additive conduit assembly 1128 includes a first additive supply line 1132*a* and a first mixing nozzle 1152*a* associated with the first additive supply line 1132*a* and shown coupled to the first fuel tank inlet 1106*a*. In the example illustrated, the additive conduit assembly 1128 further includes a second additive supply line 1132*b* and a second mixing nozzle 1152*b* associated with the second additive supply line 1132*b* and shown coupled to the second fuel tank inlet 1106*b*. The mixing nozzles 1152 and additive supply lines 1132 can be associated through, for example, the position of the mixing nozzle 1152 relative to its associated additive supply line 1132 when stored (e.g. when stored in the housing 1174 as shown in FIG. 6), a unique coupling between each mixing nozzle 1152 and its associated supply line 1132, a connection between each mixing nozzle 1152 and its associated supply line 1132 (e.g. each supply line 1132 may be connected with a respective nozzle 1152 when stored), identifiers identifying the mixing nozzle 1152 and its associated supply line 1132, sensors operable to detect which mixing nozzle 1152 is connected to which additive supply line 1132 during use, etc.

In the example illustrated, the first additive supply line 1132*a* has a first supply line inlet coupled to the additive tank 1126 for receiving the additive therefrom, and the second additive supply line 1132*b* has a second supply line inlet coupled to the additive tank 1126 for receiving the additive therefrom. In the example illustrated, the first and second additive supply lines 1132*a*, 1132*b* are coupled to the same additive tank 1126 for receiving the same type of fuel additive.

In another example, the fuel treatment system 1124 comprises a first additive tank for storing a first fuel additive and a second additive tank for storing a second fuel additive. In such an example, the first additive supply line inlet of the first additive supply line 1132*a* is coupled to the first additive tank for receiving the first additive therefrom, and the second additive supply line inlet of the second additive supply line 1132*b* is coupled to the second additive tank for receiving the second additive therefrom. The first and second additives are different types of additives (e.g. the first additive may be a gasoline additive and the second additive may be a diesel additive). Alternatively, in some examples, the first and second additives are the same.

Referring to FIG. 4, in the example illustrated, the fuel treatment system 1124 includes an additive injection system 1134 for controlling injection of the additive via the additive conduit assembly 1128. The additive injection system 1134 can include, for example, one or more additive pumps (similar to the additive pumps 138), electronic valves (similar to the valves 140), additive flow meters (similar to the flow meters 142), filters (similar to the filters 144), flow control valves (similar to the flow control valves 146), check valves (similar to the check valves 148), and/or one or more other components for facilitating and/or controlling injection of the additive from the additive tank 1126 to a fuel tank inlet 1106 via the conduit assembly 1128. In the example illustrated, the additive injection system 1134 further includes at least one injection controller 1136 operable in accordance with the methods described herein (including, for example, the methods and associated steps described with respect to the fueling station 100, including the method 200) for controlling injection of the additive via operation of the additive injection system 1134 (including, for example, the additive pumps and/or electronic valves). In the example illustrated, the injection controller 1136 is operable to control injection of the additive based on fuel data received from the fuel monitoring system 1112 of the retail fueling station 1100.

In the example illustrated, the injection controller 1136 is operable to, in response to determining that a mixing nozzle 1152 is at one of the fuel tank inlets 1106, control injection of the additive through the additive supply line 1132 connected to the mixing nozzle 1152 at that fuel tank inlet 1106 based on one or more fuel tank operating conditions of the fuel tank 1104 having that fuel tank inlet 1106.

For example, referring to FIG. 4, in response to determining that the first mixing nozzle 1152*a* is at the first fuel tank inlet 1106*a*, the injection controller 1136 is operable to control injection of the additive through the first additive supply line 1132*a* connected to the first mixing nozzle 1152*a* based on one or more first fuel tank operating conditions of the first fuel tank 1104*a* (and in some examples, according to the method 200). The first fuel tank operating conditions can include, for example, a first fuel level in the first fuel tank 1104*a*, and in some examples, a first evacuated volume of fuel evacuated from the first fuel tank 1104*a* via, for example, the dispensers of the retail fueling station 1100. In the example illustrated, the injection controller 1136 is operable to control injection based on fuel data received from the fuel monitoring system 1112 that is indicative of the fuel tank operating conditions (including, for example, the first fuel tank operating conditions).

The first mixing nozzle 1152*a* may be subsequently positioned at a different fuel tank inlet 1106 (e.g. the second, third, or fourth fuel tank inlet 1106) for delivering fuel and additive thereto. In response to determining that the first mixing nozzle 1152*a* is positioned at the different fuel tank inlet 1106, the injection controller 1136 can operate to control injection through the first additive supply line 1132*a* connected to the first mixing nozzle 1152*a* based on one or more fuel tank operating conditions of a different fuel tank 1104 (e.g. the second, third, or fourth fuel tank 1104) having the different fuel tank inlet 1106.

The injection controller 1136 can operate to control injection of additive through the second additive supply line 1132*b* and the second mixing nozzle 1152*b* in a manner similar to that described above with respect to the first additive supply line 1132*a* and the first mixing nozzle 1152*a*.

Referring to FIG. 5, in the example illustrated, each mixing nozzle 1152 includes at least one fuel tank identification sensor 1170 operable to generate at least one fuel tank identification signal when the mixing nozzle 1152 is at a fuel tank inlet 1106. In the example illustrated, the injection controller 1136 is operable to determine at which fuel tank inlet 1106 the mixing nozzle 1152 is positioned based on the fuel tank identification signal. In some examples, each fuel tank inlet 1106 can have a respective fuel tank identifier 1172 (FIG. 4), and the fuel tank identification sensor 1170 can operate to generate the fuel tank identification signal in response to detecting the fuel tank identifier associated with a respective fuel tank inlet 1106.

For example, in the retail fueling station 1100 shown in FIG. 4, the first mixing nozzle 1152*a* can include a respective fuel tank identification sensor 1170 (FIG. 5) operable to generate at least one first fuel tank identification signal when the first mixing nozzle 1152*a* is at the first fuel tank inlet 1106*a*, at least one second fuel tank identification signal when the first mixing nozzle 1152*a* is at the second fuel tank inlet 1106*b*, at least one third fuel tank identification signal when the first mixing nozzle 1152*a* is at the third fuel tank inlet 1106*c*, and at least one fourth fuel tank identification signal when the first mixing nozzle 1152*a* is at the fourth fuel tank inlet 1106*d*. In the example illustrated, each of the first, second, third, and fourth fuel tank inlets 1106*a-d* include a respective first, second, third, and fourth fuel tank identifier 1172*a-d*. The fuel tank identification sensor 1170 of the first mixing nozzle 1152*a* is operable to generate the first, second, third, or fourth fuel tank identification signals in response to detecting the first, second, third, or fourth fuel tank identifier 1172*a-d*, respectively. In the example illustrated, the injection controller 1136 is operable to determine that the first mixing nozzle 1152*a* is at the first, second, third, or fourth fuel tank inlet 1106*a-d* based on the first, second, third, or fourth tank identification signal, respectively.

The fuel tank identification sensor 1170 can be operable to generate the fuel tank identification signal based on, for example, close proximity to the fuel tank inlet 1106 and its respective fuel tank identifier, through scanning of the fuel tank identifier, through physical contact with the fuel tank identifier, etc. In some examples, the fuel tank identifier 1172 can be configured to emit a respective identifier signal, and the fuel tank identification sensor 1170 can be operable to detect the fuel tank identifier 1172 based on the presence and/or strength of the identifier signal. In some examples, the fuel tank identification sensor 1170 can be activated by a user to initiate a scan for the fuel tank identifiers 1172 for a predetermined scanning period. When a fuel tank identifier 1172 is detected (e.g. through close proximity of the sensor 1170 to the identifier 1172, such as when the mixing nozzle 1152 is positioned at a fuel tank inlet 1106 for delivering fuel and additive to the fuel tank inlet 1106), then the fuel tank identification sensor 1170 can generate the fuel tank identification signal and terminate scanning. If no fuel tank identifier 1172 is identified within the predetermined scanning period, then the fuel tank identification sensor 1170 can terminate scanning until a subsequent activation. In some examples, the fuel tank identification sensor 1170 can be motion activated (e.g. through detection of movement of a respective mixing nozzle 1152 by a user). In some examples, the fuel tank identifiers 1172 can comprise, for example, RFID tags positioned at the fuel tank inlets 1106, and the fuel tank identification sensor 1170 can comprise, for example, an RFID reader.

Figure 7:
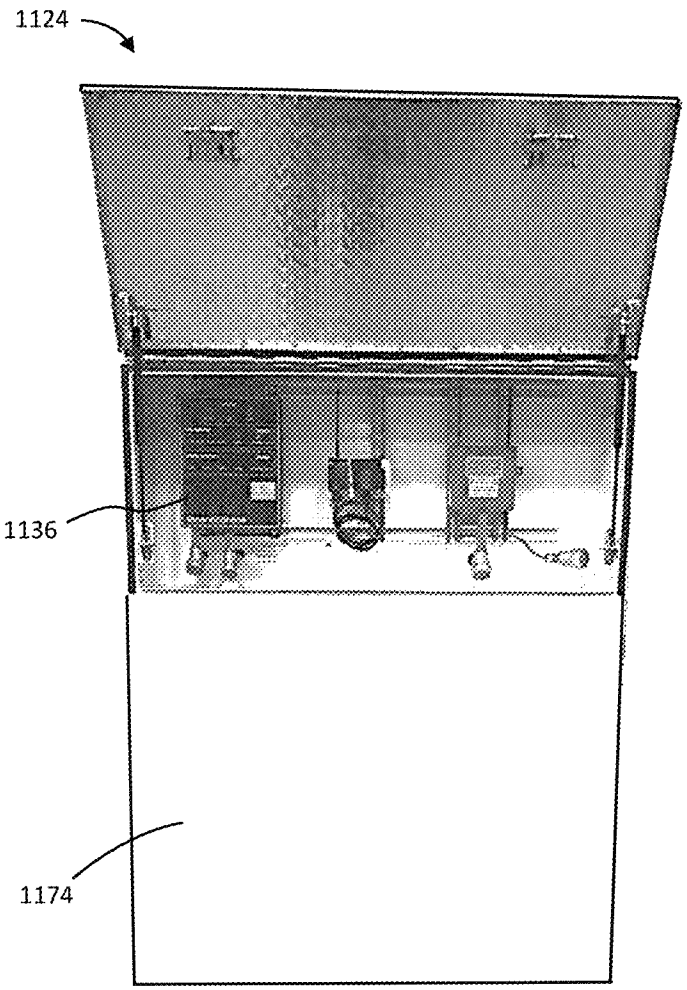
FIG. 7 is a rear view of the fuel treatment system of FIG. 4.

Referring to FIGS. 6 and 7, in the example illustrated, the fuel treatment system 1124 is configured as a portable fuel treatment system, and includes a transportable housing 1174. In the example illustrated, the additive tank 1126 is in the housing 1174, and the additive conduit assembly 1128 (including the additive supply lines 1132, reels 1150, and mixing nozzles 1152) and additive injection system 1134 (including the injection controller 1136, additive pump, valves, etc.) are supported by the housing 1174. This can facilitate transport of the fuel treatment system 1124, and/or use of the fuel treatment system 1124 without requiring underground and/or permanent installation of additive tanks and/or additive conduit assemblies.

In use, an operator takes the first mixing nozzle 1152*a* (e.g. via the handle 1166) and extends the first additive supply line 1132*a* from the housing 1174. The first mixing nozzle 1152*a* is positioned at, for example, the first fuel tank inlet 1106*a* for treatment of fuel for the first fuel tank 1104*a*. The first additive supply line 1132*a* is connected to the additive inlet 1154 of the first mixing nozzle 1152*a* (if not already connected), the nozzle outlet 1160 is connected to the first fuel tank inlet 1106*a*, and a first fuel supply line 1158 (e.g. from a fuel supply truck) is connected to the fuel supply inlet 1156.

When the first mixing nozzle 1152*a* is at the first fuel tank inlet 1106*a*, the fuel tank identification sensor 1170 of the first mixing nozzle 1152*a* generates the first fuel tank identification signal. The injection controller 1136 determines based on the first fuel tank identification signal that the first mixing nozzle 1152*a* is at the first fuel tank inlet 1106*a*, and operates to control injection of the additive from the additive tank 1126 and through the first additive supply line 1132*a* and the first mixing nozzle 1152*a* based on one or more first fuel tank operating conditions of the first fuel tank 1104*a*. In some examples, the injection controller 1136 can control injection of the additive into the first fuel tank inlet 1106*a* according to the method 200.

The operator can also take the second mixing nozzle 1152*b* (e.g. via the handle 1166) and extend the second additive supply line 1132*b* from the housing 1174. The second mixing nozzle 1152*b* is positioned at, for example, the second fuel tank inlet 1106*b* for treatment of fuel for the second fuel tank 1104*b*. The second additive supply line 1132*b* is connected to the additive inlet 1154 of the second mixing nozzle 1152*b* (if not already connected), the nozzle outlet 1160 is connected to the second fuel tank inlet 1106*b*, and a second fuel supply line 1158 (e.g. from the fuel supply truck) is connected to the fuel supply inlet 1156 of the second mixing nozzle 1152*b*.

When the second mixing nozzle 1152*b* is at the second fuel tank inlet 1106*b*, the fuel tank identification sensor 1170 of the second mixing nozzle 1152*b* generates the second fuel tank identification signal. The injection controller 1136 determines based on the second fuel tank identification signal that the second mixing nozzle 1152*b* is at the second fuel tank inlet 1106*b*, and operates to control injection of the additive from the additive tank 1126 and through the second additive supply line 1132*b* and the second mixing nozzle 1152*b* based on one or more second fuel tank operating conditions of the second fuel tank 1104*b*. In some examples, the injection controller 1136 can control injection of the additive into the second fuel tank inlet 1106*b* according to the method 200.

Fuel can then be supplied to the first and second tanks 1104*a*, 1104*b*, through the first and second fuel supply lines 1158, and additive can be injected into a stream of the fuel being delivered into the first and second tank inlets 1106*a*, 1106*b*. When filling of the first and second fuel tanks 1104*a*, 1104*b* is complete, the operator can return the mixing nozzles 1152 to the housing 1174 and retract the additive supply lines 1132.

Alternatively, if one or more of the other fuel tanks 1104 also require filling, then the operator may position one of the mixing nozzles 1152 at the fuel tank inlet 1106 of one of the other fuel tanks 1104. For example, the operator can disconnect the first mixing nozzle 1152*a* from the first fuel tank inlet 1104*a*, and move the first mixing nozzle 1152*a* to the third fuel tank inlet 1106*c* for treatment of fuel for the third fuel tank 1104*c*. The nozzle outlet 1160 of the first mixing nozzle 1152*a* can be connected to the third fuel tank inlet 1106*c*, and the first additive supply line 1132*a* and the first fuel supply line 1158 can be connected to the additive inlet 1154 and the fuel supply inlet 1156 (if previously disconnected).

When the first mixing nozzle 1152*a* is at the third fuel tank inlet 1106*c*, the fuel tank identification sensor 1170 of the first mixing nozzle 1152*a* generates the third fuel tank identification signal. The injection controller 1136 determines based on the third fuel tank identification signal that the first mixing nozzle 1152*a* is now at the third fuel tank inlet 1106*c*, and operates to control injection of the additive from the additive tank 1126 and through the first additive supply line 1132*a* and the first mixing nozzle 1152*a* based on one or more third fuel tank operating conditions of the third fuel tank 1104*c*. In some examples, the injection controller 1136 can control injection of the additive into the third fuel tank inlet 1106*c* according to the method 200.

In the example illustrated, the control components of the present specification (including those of the fuel monitoring systems 112, 1112, the additive injection systems 134, 1134, and associated sensors and/or processors) may communicate wirelessly and/or through wired connections. In some examples, the signals and/or data of the present specification may be transmitted directly between respective components and/or associated communication units, may be transmitted indirectly through a network, and/or may be processed by one or more local and/or remote processors prior to being received by the intended component.

The controllers (e.g. the controllers 114, 136, 1114, 1136) of the present specification can include, for example, one or more processors (e.g. central processing units, digital signal processors, etc.), Field Programmable Gate Arrays (FPGA), application specific integrated circuits (ASIC), and/or other types of control units capable of independently or in combination carrying out the functionality and methods of the present specification. In some examples, one or more of the controllers can include a plurality of processors, and each processor may be configured to perform dedicated tasks for carrying out the functionality and methods of the present specification. For example, in some examples, one or more of the controllers can include one or more sensor processors integrated with associated sensors (e.g. for processing sensor signals), and one or more control processors for controlling operation of system components based on sensor data received from the sensor processors. The systems of the present specification can further include computer readable memory for storing computer readable instructions retrievable by respective controllers or other system components for operation thereof.

The invention claimed is:

1. A retail fueling station configured to treat fuel for dispensing to end users at the retail fueling station, the retail fueling station comprising:

a) a fuel storage system for storing fuel, the fuel storage system including a fuel tank having a fuel tank inlet through which fuel is deliverable into the fuel tank;

b) one or more fuel dispensers connected to the fuel storage system and operable by the end users for dispensing fuel from the fuel tank;

c) a fuel monitoring system for generating fuel data based on input received from one or more fuel sensors, the fuel sensors for measuring operating conditions of the fuel storage system;

d) at least one additive tank for storing a fuel additive;

e) an additive conduit assembly for conducting additive from the additive tank to the fuel tank inlet of the fuel tank; and f) an additive injection system for controlling injection of the additive from the additive tank into the fuel tank inlet via the conduit assembly, the additive injection system including an injection controller programmed to:

i) receive the fuel data generated by the fuel monitoring system;

ii) determine, from the fuel data, a total fuel amount corresponding to a total volume of fuel present in the fuel tank at a detection time;

iii) determine an untreated fuel amount corresponding to a delivered volume of untreated fuel delivered into the fuel tank via the fuel tank inlet, the untreated fuel amount determined based on the total fuel amount and a treated fuel amount, the treated fuel amount corresponding to an expected volume of treated fuel expected to be present in the fuel tank at approximately the detection time; and iv) in response to determining that the untreated fuel amount satisfies an injection threshold, initiate injection of an injection volume of fuel additive into a fuel stream of untreated fuel being delivered into the fuel tank via the fuel tank inlet, to treat the delivered volume of untreated fuel.

2. The retail fueling station of claim 1, wherein the controller is operable to determine the treated fuel amount based on an evacuated fuel amount, the evacuated fuel amount corresponding to an evacuated volume of treated fuel evacuated from the fuel tank via operation of the dispensers.

3. The retail fueling station of claim 1, wherein the controller is operable to determine the treated fuel amount based on a transferred fuel amount, the transferred fuel amount corresponding to a transferred volume of treated fuel transferred between the fuel tank and another fuel tank of the fuel storage system via a transfer line.

4. The retail fueling station of claim 1, wherein the controller is operable to repeat (i) to (iv) for subsequent detection times to periodically inject the additive into the fuel stream in successive fuel treatment cycles until delivery of untreated fuel via the fuel tank inlet is terminated.

5. The retail fueling station of claim 4, wherein the controller is operable to, for a subsequent detection time, determine the treated fuel amount based on the untreated fuel amount determined for a preceding fuel treatment cycle and an injected additive amount corresponding to the injection volume of additive injected into the fuel tank in the preceding fuel treatment cycle.

6. The retail fueling station of claim 1, wherein the controller is operable to initiate operation of the additive injection system according to one or more injection parameters to inject the injection volume of the additive into the fuel stream; determine the injection volume injected during a first fuel treatment cycle; and adjust the one or more injection parameters to adjust the injection volume for a subsequent, second fuel treatment cycle based on the injection volume injected during the first fuel treatment cycle.

7. The retail fueling station of claim 1, wherein the additive conduit assembly includes at least one retractable additive supply line for conducting the additive from the additive tank, and at least one hand-held mixing nozzle having an additive inlet connectable to the additive supply line for receiving the additive, a fuel supply inlet connectable to a fuel supply line for receiving fuel, and a nozzle outlet in fluid communication with the fuel supply inlet and the additive inlet, the mixing nozzle positionable at the fuel tank inlet for delivering the fuel and the additive to the fuel tank inlet via the nozzle outlet.

8. An additive injection system for treating fuel at a retail fueling station, the system comprising an additive injection controller programmed to:

a) receive fuel data generated based on input received from one or more fuel sensors;

b) determine, from the fuel data, a total fuel amount corresponding to a total volume of fuel present in a fuel tank of the retail fueling station at a detection time;

c) determine an untreated fuel amount corresponding to a delivered volume of untreated fuel delivered into the fuel tank via a fuel tank inlet, the untreated fuel amount determined based on the total fuel amount and a treated fuel amount corresponding to an expected volume of treated fuel expected to be present in the fuel tank at approximately the detection time; and d) in response to determining that the untreated fuel amount exceeds an injection threshold, generate an injection signal to initiate injection of an injection volume of fuel additive into a fuel stream of untreated fuel being delivered into the fuel tank via the fuel tank inlet, to treat the delivered volume of untreated fuel.

9. The system of claim 8, wherein the controller is operable to determine the treated fuel amount based on an evacuated fuel amount, the evacuated fuel amount corresponding to an evacuated volume of treated fuel evacuated from the fuel tank via operation of one or more dispensers of the retail fueling station.

10. The system of claim 8, wherein the controller is operable to determine the treated fuel amount based on a transferred fuel amount, the transferred fuel amount corresponding to a transferred volume of treated fuel transferred between the fuel tank and another fuel tank of the retail fueling station via a transfer line.

11. The system of claim 8, wherein the controller is operable to repeat (a) to (d) for subsequent detection times to periodically generate the injection signal to inject the additive into the fuel stream in successive fuel treatment cycles until delivery of untreated fuel via the tank inlet is terminated.

12. The system of claim 11, wherein the controller is operable to, for a subsequent detection time, determine the treated fuel amount based on the untreated fuel amount determined for a preceding fuel treatment cycle and an injected additive amount corresponding to the injection volume of additive injected into the fuel tank in the preceding fuel treatment cycle.

13. The system of claim 8, wherein the controller is operable to initiate operation of the additive injection system according to one or more injection parameters to inject the injection volume of the additive into the fuel stream; determine the injection volume injected during a first fuel treatment cycle; and adjust the one or more injection parameters to adjust the injection volume for a subsequent, second fuel treatment cycle based on the injection volume injected during the first fuel treatment cycle.

* * * * *